United States Patent [19]

Kanzaka

[11] 4,193,172

[45] Mar. 18, 1980

[54] ORNAMENTAL ATTACHMENT FOR SLIDE FASTENER SLIDERS

[75] Inventor: Yoshihiro Kanzaka, Nyuzen, Japan

[73] Assignee: Yoshida Kogyo K.K., Tokyo, Japan

[21] Appl. No.: 903,175

[22] Filed: May 5, 1978

[30] Foreign Application Priority Data

May 12, 1977 [JP] Japan ..... 52-60449
May 12, 1977 [JP] Japan ..... 52-60450

[51] Int. Cl.[2] ..... A44B 19/00
[52] U.S. Cl. ..... 24/205.15 H
[58] Field of Search ..... 24/205.15 R, 205.15 H, 24/113 MP, 113 R; 16/116 R; 294/1 A; 403/361

[56] References Cited

U.S. PATENT DOCUMENTS

| | | | |
|---|---|---|---|
| 2,232,756 | 2/1941 | Marcus | 24/205.15 H |
| 2,292,484 | 8/1942 | Schwartz | 24/205.15 H |
| 3,249,977 | 5/1966 | Cloud, Sr. | 24/205.15 H |

FOREIGN PATENT DOCUMENTS

| | | | |
|---|---|---|---|
| 7101830 | 4/1971 | Fed. Rep. of Germany | 24/205.15 H |

*Primary Examiner*—Philip C. Kannan
*Attorney, Agent, or Firm*—Bucknam and Archer

[57] ABSTRACT

An ornamental attachment for being mounted on a slider pull tab for a slide fastener comprises a body having a pair of upper and lower plates between which is defined a channel for receiving therein the slider pull tab, there being means in the channel for locking the pull tab upon full insertion thereof into the channel. An elongate land and a pair of grooves one on each side of the land are provided on at least one of the upper and lower plates, the land being resiliently engageable flatwise with the pull tab for its positional stability in the channel against wobbling movement. The upper and lower plates include a pair of resilient lips between which the pull tab is insertable into the channel, one of the lips having a pair of retainer means for holding the inserted pull tab therebetween against sideways displacement in the channel. Such retainer means may be on a pair of spacers interconnecting the upper and lower plates, the retainer means projecting into the channel toward one another.

10 Claims, 9 Drawing Figures

FIG. 1
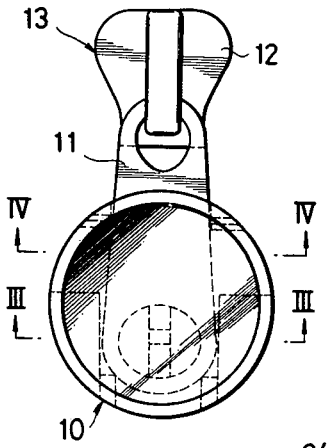
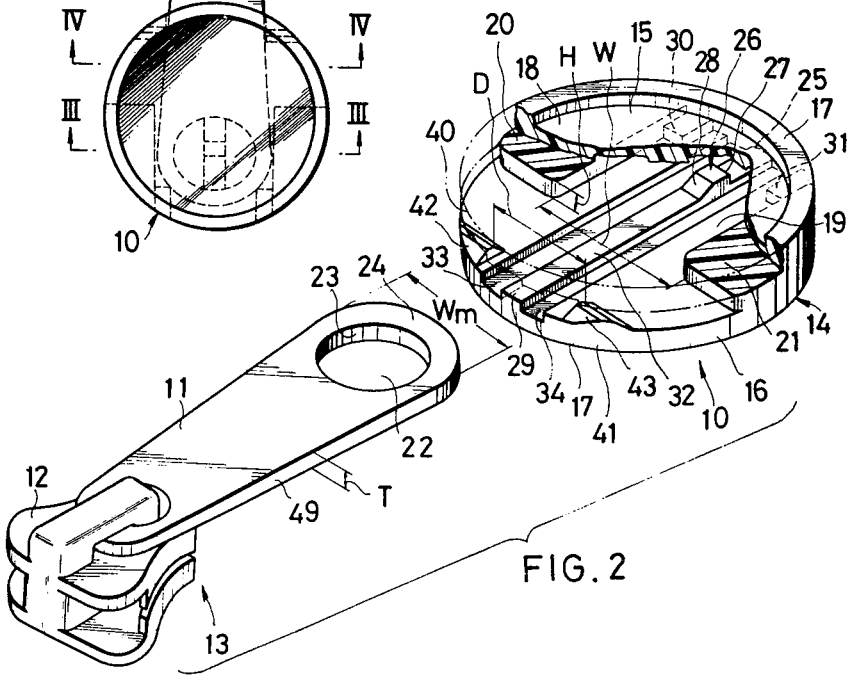
FIG. 2
FIG. 3
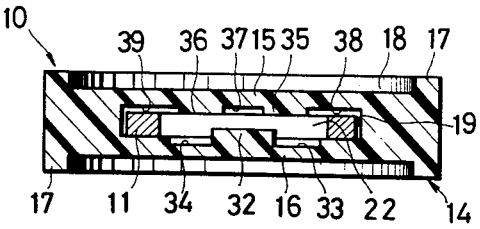

ORNAMENTAL ATTACHMENT FOR SLIDE FASTENER SLIDERS

BACKGROUND OF THE INVENTION

1. Field of the Invention

The present invention relates to an ornamental attachment mountable on the pull tab of a slide fastener slider.

2. Prior Art

Modern slide fasteners are frequently required to have a pleasing appearance especially on the slider pull tab which is usually exposed to view when the slide fasteners are attached to garments. Various ornamental pull tab attachments have been proposed for use as a decorative accessory and also for being handled by the user for reliable manipulation of the slider. One such proposal is represented by an attachment having a hole in which the pull tab of a slider is inserted and secured in position. With the prior arrangement, the pull tab insertion hole must be so dimensioned that the pull tab will be closely fitted therein for positional stability against a wobble relative to the attachment. However, since the pull tab is normally coated with paint, an excessive amount of paint that may be deposited all over or locally on the pull tab tends to hinder the pull tab from entering the attachment hole. Additionally, both the pull tab and the attachment are subject to deformation with aging or during usage, with the result that they cannot be assembled together or they will become loosened relatively to one another. Sizing the attachment hole to accommodate such dimensional variations may be helpful to put the pull tab into the hole, but does not work well for preventing the pull tab from wobbling therein.

SUMMARY OF THE INVENTION

An ornamental attachment has a pull tab insertion channel in its body, defined between a pair of plates at least one of which has an elongate land and a pair of grooves one on each side thereof, the elongate land being adapted for flatwise engagement with the pull tab. The pair of plates have portions acting respectively as a pair of resilient lips between which the pull tab is insertable into the channel. There is a locking means disposed adjacent to one end of the channel for locking the pull tab in the channel, and a pair of retainers on one of the plates at the other end of the channel for engagement with side edges of the pull tab when it is locked by the locking means. The pair of retainers may be provided on a pair of spacers interconnecting the pair of plates, such retainers projecting into the channel toward one another.

It is an object of the present invention to provide an ornamental attachment that can be easily assembled onto the pull tab of a slide fastener slider.

It is another object of the present invention to provide an ornamental attachment that, when attached to a slider pull tab, is retained reliably and stably thereon against wobbling movement.

The above and other objects and advantages of the invention will become apparent from the following description when taken in conjunction with the accompanying drawings.

BRIEF DESCRIPTION OF THE DRAWINGS

FIG. 1 is a plan view of an ornamental attachment constructed in accordance with the present invention, the attachment being mounted on a slide fastener slider;

FIG. 2 is an enlarged perspective view, with parts cut away, of the ornamental attachment shown in FIG. 1, the attachment being in a position ready for assembling onto the slider;

FIG. 3 is an enlarged cross-sectional view taken along line III—III of FIG. 1;

DETAILED DESCRIPTION OF THE PREFERRED EMBODIMENTS

Figure 4:
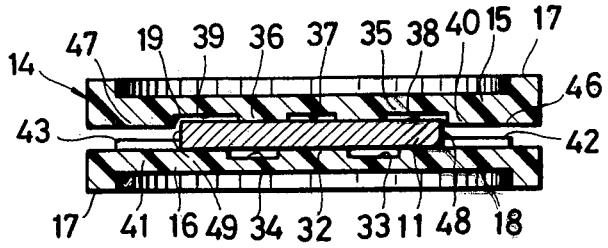
FIG. 4 is an enlarged cross-sectional view taken along line IV—IV of FIG. 1.

As shown in FIG. 1, an ornamental attachment 10 of the present invention is mounted on a pull tab 11 pivotally coupled at one end to a slider body 12 of a slider fastener slider 13, the attachment 10 being decorated with a suitable design or marking (not shown). The ornamental attachment 10 also acts as a pull tab manipulating aid which enables the user to handle the pull tab 11 reliably.

As best illustrated in FIG. 2, the ornamental attachment 10 includes a body 14 made of a resilient material such as synthetic resin, the body 14 having a pair of upper and lower plates or walls 15, 16 that are circular in shape. Each of the circular plates 15, 16 has a rim 17 encircling a flat surface 18 on which the decorative design or marking is provided. The upper and lower plates 15, 16 are spaced from each other and define therebetween a channel 19 for receiving the pull tab 11, the channel 19 extending diametrically across the attachment body 14. The plates 15, 16 are interconnected by a pair of spacer blocks 20, 21 spaced from each other and located between the spaced plates 15, 16, the channel 19 extending between the spacer blocks 20, 21.

The channel 19 has a height H and a width W that substantially correspond to the thickness T and the maximum width Wm of the pull tab 11 of the slider 13 on which the attachment 10 is to be mounted. The slider pull tab 11 has an opening 22 located remotely from the pivoted end and bounded by an annular edge 23, thereby providing an arcuate distal portion 24. There is a pull tab locking means adjacent to one end 25 of the channel 19, comprising a central projection 16 projecting from the lower plate 16 into the channel 19 and located between and equidistantly from the spacer blocks 20, 21. The projection 16 has vertical edge 27 facing the channel end 25, and an inclined surface 28 that is tapered off toward the other end 29 of the channel 19. When the pull tab 11 is inserted in position in the channel 19, the vertical edge 27 of the projection 26 engages the annular edge 23 of the pull tab 11 for locking the pull tab 11 in the channel 19 against removal therefrom. The locking means also comprises a pair of retaining projections 30, 31 on the lower plate 16 located at the channel end 25 adjacent to the central projection 26 and spaced from each other, the projections 30, 31 being contiguous to the spacer blocks 20, 21, respectively. The projections 30, 31 engage and retain the pull tab 11 when it is locked by the central projection 16 in the channel 19.

The lower plate 16 has a central elongate land 32 on its surface facing the upper plate 15, the land 32 extending longitudinally along the channel 19 and on which the central projection 26 is positioned. The elongate land 32 is bordered by and between a pair of grooves 33, 34 disposed in the lower plate 16 and extending one along each side of the land 32. As best shown in FIGS. 3 and 4, the upper plate 15 has a pair of elongate lands 35, 36 on its surface facing the lower plate 16, the lands 35, 36 extending along the channel 19 and located in substantially superposing relation with grooves 33, 34, respectively, in the lower plate 16. One of the lands 35 is defined between a central groove 37 and an outer groove 38, the central groove 37 being located above the land 32 on the lower plate 16. The other land 36 is bounded between the central groove 37 and another outer groove 39.

With the grooves 33, 34 in the lower plate 16 and the grooves 37, 38 and 39 in the upper plate 15, the portions of the plates 15, 16 which define the channel 19 are relatively flexible, permitting the elongate lands 32, 35 and 36 to engage flatwise independently with the surfaces of the slider pull tab 11. More specifically, when any such land is pushed backwardly by deformations or changes in thickness of the pull tab 11 inserted, adjacent grooves can take up stresses exerted in the plates 15, 16 and prevent such stresses from being imposed upon adjacent lands, which are then allowed to be held in flatwise engagement with the pull tab 11. Accordingly, the pull tab 11 can be positionally stabilized against wobbling movement by resilient contact with as wide areas as there are the lands. The grooves also function to accommodate any projections or burrs that may be on the pull tab 11 and that happen to correspond positionally to such grooves.

Figure 7:
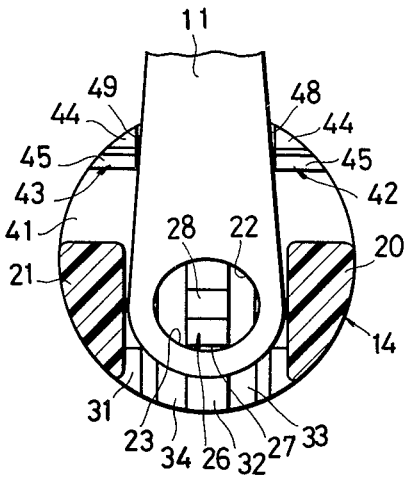
FIG. 7 is a horizontal cross-sectional view of the ornamental attachment in which the slider pull tab is inserted.

In FIGS. 2 and 7, the spacer blocks 20, 21 terminate short of the end 29 of the channel 19, or extend substantially halfway along the channel 19, thereby allowing the opposed or confronting portions of the upper and lower plates 15, 16 which extend beyond the spacer blocks 20, 21 to act as a pair of resilient lips 40, 41 between which the pull tab 11 is insertable into the channel 19. A pair of retainer ridges 42, 43 located at the channel end 29 project from the lower plate 16 toward the upper plate 15, the retainer ridges 42, 43 being spaced from each other a distance D smaller than the width W of the channel 19, such that they are in the way of the pull tab 11 when it is to be inserted into the channel 19. Each of the retainer ridges 42, 43 has slanted surfaces 44, 45 that facilitate the sliding movement of the pull tab 11 thereover into the channel 19. Such retainer ridges 42, 43 are particularly useful where a slider pull tab to be inserted has a tapered width such as shown in FIGS. 1, 2, and 7. The distance D at which the retainer ridges 42, 43 are spaced from each other is thus smaller than the maximum width Wm of the pull tab 11.

As illustrated in FIG. 4, the upper plate 15 has a pair of sidewalls 46, 47 which partly define the potions of the outer grooves 38, 39, respectively, which extend beyond the spacer blocks 20, 21, the sidewalls 46, 47 projecting toward the lower plate 16 beyond the lower surface of the lands 35, 36 on the upper plate 15. The channel 19 is bounded by and between the sidewalls 46, 47 where it is located between the lips 40, 41.

Figure 5:
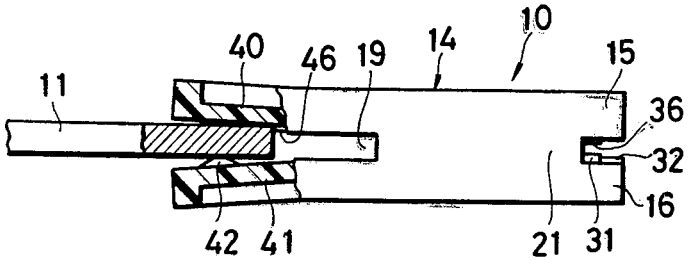
FIG. 5 is a side elevational view showing the ornamental attachment while being assembled onto the slider pull tab.
Figure 6:
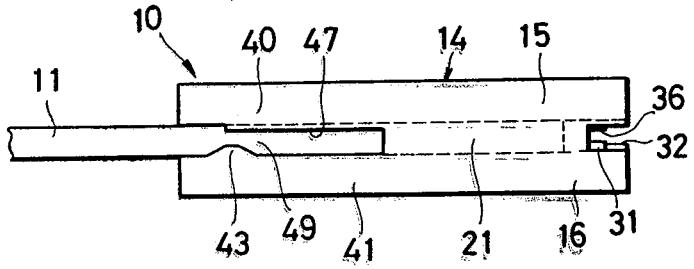
FIG. 6 is a side elevational view showing the ornamental attachment mounted on the slider pull tab.

When the ornamental attachment 10 is to be mounted on the pull tab 11, the pull tab 11 is inserted between the lips 40, 41 longitudinally into the channel 19 at its end 29, whereupon the pull tab 11 slides over the retainer ridges 42, 43 and forces the lips 40, 41 apart as shown in FIG. 5. The pull tab 11 is pushed on forcibly into the channel 19 until the arcuate distal portion 24 of the pull tab 11 slides onto and over the tapered surface 28 of the projection 26 as the upper and lower plates 15, 16 spread apart, and then snaps downwardly over the projection 26 under the resiliency of the plates 15, 16. At this time, the arcuate portion 24 of the pull tab 11 is engaged by the pair of retaining projections 30, 31 and is prevented from moving further. The vertical edge 27 of the central projection 26 engages the opening edge 23 of the pull tab 11, thereby holding the pull tab 11 in the channel 19 against removal therefrom. When the pull tab 11 is thus locked by the locking means, a portion of the pull tab 11 which has a width smaller than the maximum width Wm of the pull tab 11 is fitted between the retainer ridges 42, 43, whereupon the lips 40, 41 spring back toward each other under their resiliency into contact with the surfaces of the pull tab 11 (FIG. 6). Accordingly, the pull tab 11 is prevented from dislodgement and sideways displacement by the pair of retainer ridges 42. 43 that engage side edges 48, 49, respectively, of the pull tab 11. The pull tab 11 is positioned stably in the channel 19 by its flatwise contact with the lands on the upper and lower plates 15, 16.

Figure 8:
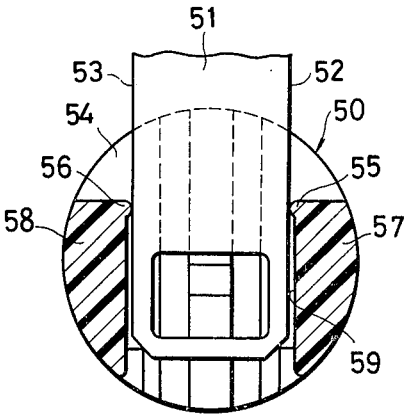
FIG. 8 is a view similar to FIG. 7, showing a modified ornamental attachment.

FIG. 8 illustrates a modified ornamental attachment 50 for a slider pull tab 51 which is rectangular in shape and thus has parallel side edges 52, 53. The attachment 50 has no retainer ridges on its lower lip 54. Instead, a pair of retainer protrusions 55, 56 project from a pair of spacer blocks 57, 58, respectively, toward each other into a channel 59 for abutting engagement with the side edges 52, 53, respectively, of the pull tab 51, thereby retaining the pull tab 11 against sidewise movement in the channel 59.

Figure 9:
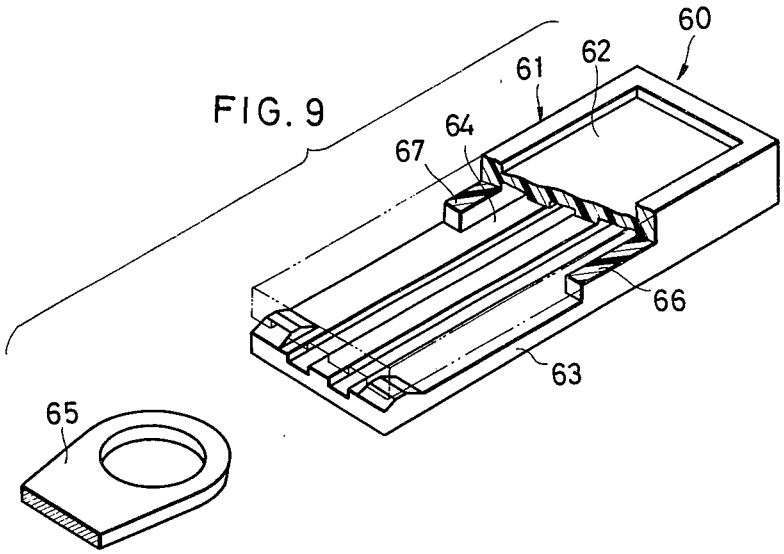
FIG. 9 is a perspective view, partly broken away, of an ornamental attachment provided according to another embodiment of the invention.

According to a modification shown in FIG. 9, an ornamental attachment 60 comprises a body 61 including a pair of upper and lower rectangular plates 62, 63 defining therebetween a channel 64 for receiving a slider pull tab 65 therein, the upper and lower plates 62, 63 being interconnected by a pair of sidewalls 66, 67 extending halfway along the side edges of the plates 62, 63. The other structural details and the way in which the attachment 60 is assembled onto the pull tab 65 are the same as those disclosed in connection with the embodiment shown in FIGS. 1 through 7.

Although certain preferred embodiments of the invention have been shown and described for the purposes of illustrat'on, it is to be understood that various changes and modifications may be made without departing from the scope of the appended claims.

I claim as my invention:

1. An ornamental attachment for a slide fastener slider with a pull tab, comprising:

(a) a body having a pair of spaced plates defining therebetween a channel for receiving the pull tab;

(b) means in said channel for locking the pull tab in the channel; and (c) means on at least one of said plates for positionally stabilizing the pull tab in said channel, said stabilizing means including at least one land projecting from one of said plates into said channel to resiliently engage the pull tab therein.

2. An ornamental attachment according to claim 1 for a slide fastener slider with a pull tab having an opening bounded by an edge, said locking means comprising a first projection extending from one of said plates into said channel, said first projection having an edge adapted for locking engagement with the pull tab opening edge.

3. An ornamental attachment according to claim 2, said locking means further comprising means on one of said plates for retaining the pull tab in a position in which the pull tab is locked by said first projection.

4. An ornamental attachment according to claim 3, said retaining means comprising a pair of second projections located adjacent to said first projection and spaced from each other, said second projections being engageable with the pull tab in said position.

5. An ornamental attachment according to claim 1, said stabilizing means comprising at least one elongate land extending longitudinally along said channel and engageable flatwise with the pull tab, there being a pair of grooves disposed in said one plate and extending one along each side of said land.

6. An ornamental attachment accoding to claim 5, said locking means projecting from said land.

7. An ornamental attachment according to claim 1, including a pair of spacer means spaced from each other and located between said spaced plates, said channel extending between said pair of spacer means, and said locking means being disposed adjacent to one end of said channel and between said pair of spacer means.

8. An ornamental attachment according to claim 7, said pair of spacer means terminating short of the other end of said channel, thereby allowing the opposed portions of said pair of plates which extend beyond said spacer means to act as a pair of resilient lips between which the pull tab is inserted into said channel.

9. An ornamental attachment according to claim 8, including a pair of retainer ridges projecting from one of said plates toward the other and located at said one end of the channel, said retainer ridges being spaced from each other a distance smaller than the width of said channel, and said retainer ridges being engageable with side edges of the pull tab when the latter is locked by said locking means.

10. An ornamental attachment according to claim 8, including a pair of retainer protrusions projecting respectively from said pair of spacer means toward each other into said channel, said retainer protrusions being spaced from each other a distance smaller than the width of said channel, and said retainer protrusions being engageable with side edges of the pull tab when the latter is locked by said locking means.

* * * * *